US011506062B2

(12) United States Patent
Kim et al.

(10) Patent No.: US 11,506,062 B2
(45) Date of Patent: Nov. 22, 2022

(54) TURBINE BLADE, AND TURBINE AND GAS TURBINE INCLUDING THE SAME

(71) Applicant: DOOSAN ENERBILITY CO.. LTD, Changwon-si (KR)

(72) Inventors: Kwang Il Kim, Jeonju (KR); Jin Woo Song, Changwon (KR); Willy Heinz Hofmann, Changwon (KR); Herbert Brandl, Changwon (KR)

( * ) Notice: Subject to any disclaimer, the term of this patent is extended or adjusted under 35 U.S.C. 154(b) by 0 days.

(21) Appl. No.: 17/398,088

(22) Filed: Aug. 10, 2021

(65) Prior Publication Data

US 2022/0098986 A1 Mar. 31, 2022

(30) Foreign Application Priority Data

Sep. 25, 2020 (KR) ..... 10-2020-0125082

(51) Int. Cl.
*F01D 5/18* (2006.01)

(52) U.S. Cl.
CPC ..... *F01D 5/186* (2013.01); *F01D 5/187* (2013.01); *F05D 2240/305* (2013.01); *F05D 2240/81* (2013.01); *F05D 2260/202* (2013.01)

(58) Field of Classification Search
CPC . F01D 5/186; F01D 5/187; F01D 5/20; F05D 2240/307; F05D 2240/305
See application file for complete search history.

(56) References Cited

U.S. PATENT DOCUMENTS

| | | | | |
|---|---|---|---|---|
| 4,589,823 | A * | 5/1986 | Koffel | F01D 5/20 416/241 B |
| 7,300,250 | B2 | 11/2007 | Papple | |
| 8,092,178 | B2 | 1/2012 | Marini | |
| 10,227,876 | B2 * | 3/2019 | Buhler | F01D 5/20 |
| 10,822,957 | B2 * | 11/2020 | Buhler | F01D 5/20 |
| 2002/0197160 | A1 | 12/2002 | Liang | |
| 2005/0025623 | A1 * | 2/2005 | Botrel | F01D 5/187 416/97 R |
| 2010/0135822 | A1 * | 6/2010 | Marini | F01D 5/20 416/97 R |

(Continued)

FOREIGN PATENT DOCUMENTS

| | | | |
|---|---|---|---|
| EP | 3199763 | A1 | 11/2016 |
| JP | 2001511864 | A | 8/2001 |

(Continued)

OTHER PUBLICATIONS

EESR dated Jan. 17, 2022.
KR OA, dated Mar. 3, 2022.
JP OA dated Aug. 9, 2022.

*Primary Examiner* — Eldon T Brockman
(74) *Attorney, Agent, or Firm* — Harvest IP Law, LLP

(57) ABSTRACT

A turbine blade that allows an improvement in torque and power, and a turbine and gas turbine including the same are provided. The turbine blade includes an airfoil having a suction side and a pressure side, a platform coupled to a bottom of the airfoil, and a root protruding downward from the platform and coupled to a rotor disk, wherein the airfoil includes a cooling passage formed therein and a discharge hole connected to an upper portion of the cooling passage to discharge cooling air, and the discharge hole is inclined toward a tip of the turbine blade while extending from an inside to an outside thereof.

18 Claims, 7 Drawing Sheets

(56) References Cited

U.S. PATENT DOCUMENTS

| | | | | |
|---|---|---|---|---|
| 2010/0239409 | A1* | 9/2010 | Draper | F01D 5/186 29/889.1 |
| 2012/0282108 | A1 | 11/2012 | Lee | |
| 2013/0302166 | A1 | 11/2013 | Lee | |
| 2017/0159450 | A1* | 6/2017 | Buhler | F01D 5/20 |
| 2019/0145265 | A1* | 5/2019 | Buhler | F01D 5/186 416/97 R |
| 2020/0018190 | A1 | 1/2020 | Crites | |

FOREIGN PATENT DOCUMENTS

| | | | |
|---|---|---|---|
| JP | 2005054799 | A | 3/2005 |
| JP | 4287795 | B2 | 7/2009 |
| JP | 2014066224 | A | 4/2014 |
| JP | 2016173106 | A | 9/2016 |
| JP | 2017115862 | A | 6/2017 |
| JP | 2017198205 | A | 11/2017 |
| KR | 101276760 | B1 | 6/2013 |
| KR | 101573409 | B1 | 12/2015 |
| KR | 102021139 | B1 | 10/2019 |
| KR | 102153066 | B1 | 9/2020 |

* cited by examiner

TURBINE BLADE, AND TURBINE AND GAS TURBINE INCLUDING THE SAME

CROSS-REFERENCE TO RELATED APPLICATION

This application claims priority to Korean Patent Application No. 10-2020-0125082, filed on Sep. 25, 2020, the disclosure of which is incorporated herein by reference in its entirety.

BACKGROUND

Technical Field

Apparatuses and methods consistent with exemplary embodiments relate to a turbine blade, and a turbine and gas turbine including the same.

Description of the Related Art

A gas turbine is a power engine that mixes air compressed by a compressor with fuel for combustion and rotates a turbine with high-temperature gas produced by the combustion. The gas turbine is used to drive a generator, an aircraft, a ship, a train, and so forth.

This gas turbine includes a compressor, a combustor, and a turbine. The compressor sucks and compresses outside air, and transmits the compressed air to the combustor. The air compressed by the compressor becomes high-pressure and high-temperature. The combustor mixes the compressed air supplied from the compressor with fuel and burns a mixture thereof to generate a high temperature and high-pressure combustion gas. The combustion gas produced by the combustion is discharged to the turbine. Turbine blades in the turbine are rotated by the combustion gas, thereby generating power. The generated power is used in various fields, such as generating electric power and actuating machines.

Recently, to increase the efficiency of the turbine, the temperature of the gas entering the turbine (which is also referred to as "turbine inlet temperature (TIT)") has been continuously increasing. For this reason, the importance of heat-resistant treatment and cooling of the turbine blades is being highlighted.

A method of cooling a turbine blade includes a film cooling method and an internal cooling method. The film cooling method is a method of forming a coating film on an outer surface of the turbine blade to prevent heat transfer from the outside to the turbine blade. According to the film cooling method, the heat-resistant coating applied to the turbine blade determines the heat resistance and mechanical durability of the turbine blade.

The internal cooling method is a method of cooling the turbine blade through heat exchange between the cooling fluid and the turbine blade. The turbine blade is commonly cooled by compressed cooling air supplied from the compressor of the gas turbine.

The turbine blade has an airfoil whose tip is positioned at a radially outermost side thereof. It is very difficult to cool the airfoil tip because it is disposed adjacent to a turbine shroud. To this end, a related art tip rib extends around the airfoil tip and is formed to surround a tip plate of the airfoil, and in which state, air is blown into the tip plate to cool the airfoil tip. Blowing air into the tip plate may prevent a loss in pressure while cooling the tip plate, but may not increase the torque and power of the turbine.

SUMMARY

Aspects of one or more exemplary embodiments provide a turbine blade that allows an improvement in torque and power, and a turbine and gas turbine including the same.

Additional aspects will be set forth in part in the description which follows and, in part, will become apparent from the description, or may be learned by practice of the exemplary embodiments.

According to an aspect of an exemplary embodiment, there is provided a turbine blade including: an airfoil having a suction side and a pressure side, a platform coupled to the bottom of the airfoil, and a root protruding downward from the platform and coupled to a rotor disk, wherein the airfoil includes a cooling passage formed therein and a discharge hole connected to an upper portion of the cooling passage to discharge cooling air, and the discharge hole is inclined toward a tip of the turbine blade while extending from an inside to an outside thereof.

The discharge hole may be formed only on the pressure side among the suction side and the pressure side.

The discharge hole may extend parallel to a rotational direction of the turbine blade.

The discharge hole may be inclined toward a leading edge of the turbine blade while extending from the inside to the outside thereof.

The turbine blade may include a plurality of cooling holes formed to discharge cooling air, and the discharge hole may be positioned outside one of the cooling holes and have a larger diameter than the cooling hole.

The discharge hole may form an inclination angle with a plane perpendicular to a height direction of the turbine blade, the inclination angle being 5 to 15 degrees or 35 to 45 degrees.

The airfoil may further include a tip plate connected to the suction side and the pressure side and disposed outward, the tip plate being a closed plate having no opening.

The cooling passage may be provided with a flow extension connected to the discharge hole, the flow extension protruding into the cooling passage. The flow extension may include an upper extension protruding obliquely with respect to an inner surface of the tip plate and a side extension protruding obliquely with respect to the pressure side.

The cooling passage may be provided with a flow guide connected to the discharge hole, the flow guide protruding into the cooling passage. The flow guide may include a first guide protruding from a lower surface of the tip plate and the suction side to be connected to the discharge hole and a second guide protruding from the pressure side to be connected to the discharge hole, the first guide being formed of a curved surface.

The discharge hole may include a compression passage whose inner diameter gradually decreases outward, and a guide passage extending from the compression passage to the pressure side and having a uniform inner diameter.

A blowing ratio may be defined as the product of a discharge velocity of air exiting the turbine blade and a density of the air divided by the product of a velocity of combustion gas passing through an outer surface of the turbine blade and a density of the combustion gas. The blowing ratio of the air exiting through the discharge hole and the combustion gas passing through the turbine blade may be 4 to 10.

According to an aspect of another exemplary embodiment, there is provided a turbine including: a rotor disk configured to be rotatable and a plurality of turbine blades installed on the rotor disk, wherein each of the turbine blades includes an airfoil having a suction side and a pressure side, a platform coupled to a bottom of the airfoil, and a root protruding downward from the platform and coupled to the rotor disk, wherein the airfoil includes a cooling passage formed therein and a discharge hole connected to an upper portion of the cooling passage to discharge cooling air, and the discharge hole is inclined toward a tip of the turbine blade while extending from an inside to an outside thereof.

The discharge hole may be formed only on the pressure side among the suction side and the pressure side.

The discharge hole may extend parallel to a rotational direction of the turbine blade.

The discharge hole may be inclined toward a leading edge of the turbine blade while extending from the inside to the outside thereof.

The turbine blade may include a plurality of cooling holes formed to discharge cooling air, and the discharge hole may be positioned outside one of the cooling holes and have a larger diameter than the cooling hole.

The discharge hole may form an inclination angle with a plane perpendicular to a height direction of the turbine blade, the inclination angle being 5 to 15 degrees or 35 to 45 degrees.

The airfoil may further include a tip plate connected to the suction side and the pressure side and disposed outward, the tip plate being a closed plate having no opening.

The cooling passage may be provided with a flow extension connected to the discharge hole, the flow extension protruding into the cooling passage. The flow extension may include an upper extension protruding obliquely with respect to an inner surface of the tip plate and a side extension protruding obliquely with respect to the pressure side.

According to an aspect of another exemplary embodiment, there is provided a gas turbine including: a compressor configured to compress air introduced thereinto from an outside, a combustor configured to mix fuel with air compressed by the compressor for combustion, and a turbine including a plurality of turbine blades rotated by combustion gas produced by the combustor, wherein each of the turbine blades includes an airfoil having a suction side and a pressure side, a platform coupled to the bottom of the airfoil, and a root protruding downward from the platform and coupled to the rotor disk, wherein the airfoil includes a cooling passage formed therein and a discharge hole connected to an upper portion of the cooling passage to discharge cooling air, and the discharge hole is inclined toward a tip of the turbine blade while extending from an inside to an outside thereof.

BRIEF DESCRIPTION OF THE DRAWINGS

The above and other aspects will become more apparent from the following description of the exemplary embodiments with reference to the accompanying drawings, in which.

DETAILED DESCRIPTION

Figure 1:
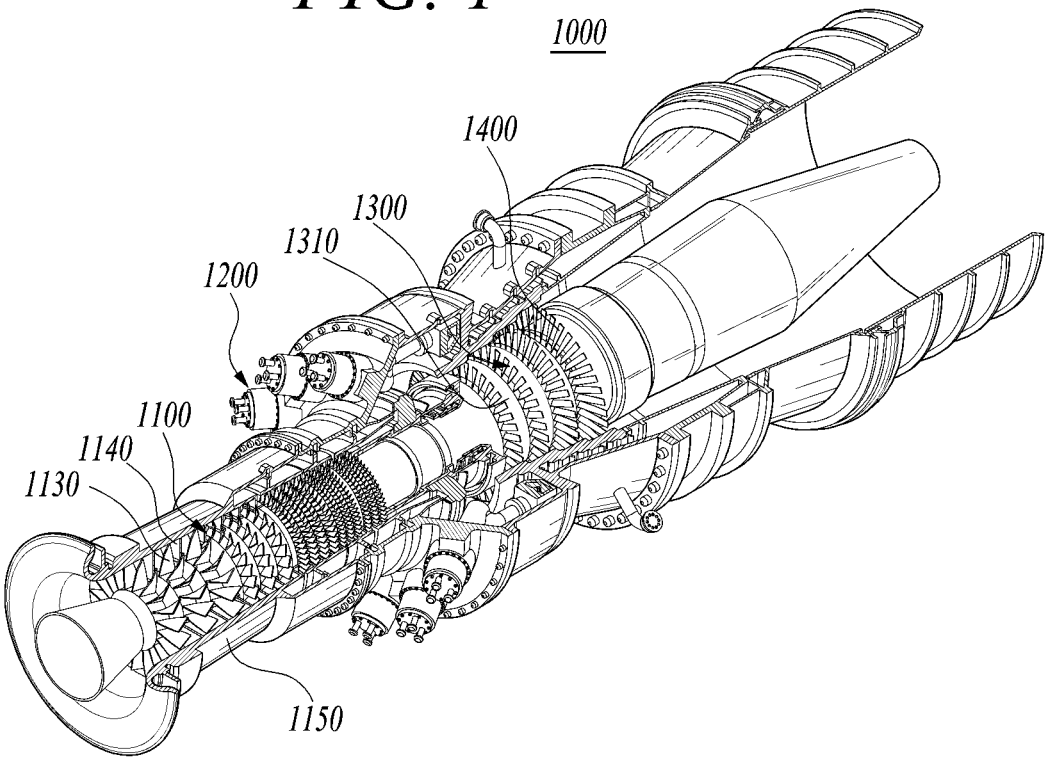
FIG. 1 is a view illustrating an interior of a gas turbine according to an exemplary embodiment.

Various modifications and various embodiments will be described below in detail with reference to the accompanying drawings so that those skilled in the art can easily carry out the disclosure. It should be understood, however, that the various embodiments are not for limiting the scope of the disclosure to the specific embodiment, but they should be interpreted to include all modifications, equivalents, and alternatives of the embodiments included within the spirit and scope disclosed herein.

The terminology used herein is for the purpose of describing specific embodiments only and is not intended to limit the scope of the disclosure. The singular expressions "a", "an", and "the" are intended to include the plural expressions as well unless the context clearly indicates otherwise. In the disclosure, terms such as "comprises", "includes", or "have/has" should be construed as designating that there are such features, integers, steps, operations, components, parts, and/or combinations thereof, not to exclude the presence or possibility of adding of one or more of other features, integers, steps, operations, components, parts, and/or combinations thereof.

Exemplary embodiments will be described below in detail with reference to the accompanying drawings. It should be noted that like reference numerals refer to like parts throughout the various figures and exemplary embodiments. In certain embodiments, a detailed description of functions and configurations well known in the art may be omitted to avoid obscuring appreciation of the disclosure by a person of ordinary skill in the art. For the same reason, some components may be exaggerated, omitted, or schematically illustrated in the accompanying drawings.

Figure 2:
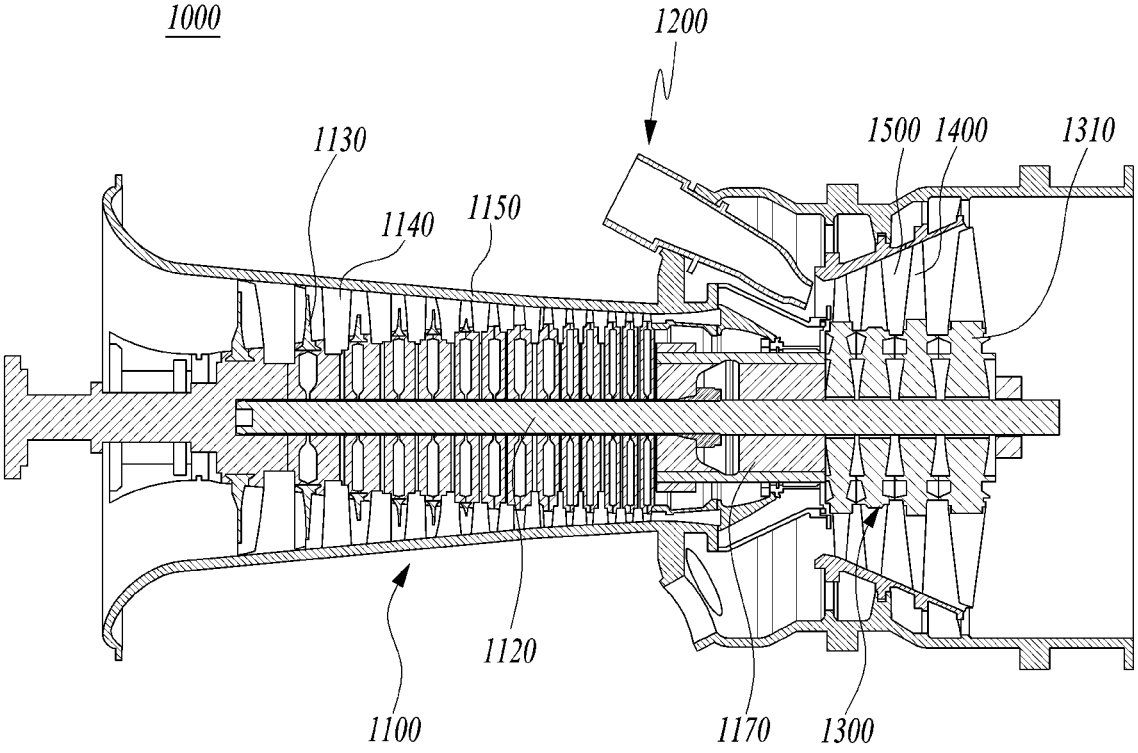
FIG. 2 is a cross-sectional view illustrating a schematic structure of the gas turbine of FIG. 1.

FIG. 1 is a view illustrating an interior of a gas turbine according to an exemplary embodiment. FIG. 2 is a cross-sectional view illustrating a schematic structure of the gas turbine of FIG. 1.

For example, the thermodynamic cycle of the gas turbine 1000 according to the exemplary embodiment may ideally comply with the Brayton cycle. The Brayton cycle consists of four phases including an isentropic compression (i.e., an adiabatic compression), an isobaric heat addition, an isentropic expansion (i.e., an adiabatic expansion), and an isobaric heat dissipation. In other words, in the Brayton cycle, thermal energy may be released by combustion of fuel in an isobaric environment after the atmospheric air is sucked and compressed to a high pressure, hot combustion gas may be expanded to be converted into kinetic energy, and exhaust gas with residual energy may then be discharged to the atmosphere. As such, the Brayton cycle consists of four processes, i.e., compression, heating, expansion, and exhaust.

Referring to FIGS. 1 and 2, the gas turbine 1000 may include a compressor 1100, a combustor 1200, and a turbine 1300.

The compressor 1100 may suck air from the outside and compress the air. The compressor 1100 may supply air compressed by compressor blades 1130 to the combustor 1200 and also supply cooling air to a high-temperature region required for cooling in the gas turbine 1000. In this case, drawn air is compressed in the compressor 1100 through an adiabatic compression process, so that the pressure and temperature of the air passing through the compressor 1100 increase.

The compressor 1100 is designed as a centrifugal compressor or an axial compressor. The centrifugal compressor is applied to a small gas turbine, whereas a multistage axial compressor 1100 is applied to a large gas turbine 1000 as illustrated in FIG. 1 to compress a large amount of air. In the multistage axial compressor 1100, the compressor blades 1130 rotate along with rotation of rotor disks together with a center tie rod 1120 to compress air introduced thereinto while delivering the compressed air to rear-stage compressor vanes 1140. The air is compressed increasingly to a high pressure while passing through the compressor blades 1130 formed in a multistage structure.

A plurality of compressor vanes 1140 may be mounted in a compressor casing 1150 in such a way that the plurality of compressor vanes 1140 form each stage. The compressor vanes 1140 guide the compressed air transferred from compressor blades 1130 disposed at a preceding stage, to compressor blades 1130 disposed at the following stage. In an exemplary embodiment, at least some of the plurality of compressor vanes 1140 may be mounted so as to be rotatable within a predetermined range, e.g., to adjust the inflow rate of air.

The compressor 1100 may be driven by some of the power output from the turbine 1300. To this end, a rotary shaft of the compressor 1100 may be directly connected to a rotary shaft of the turbine 1300 by a torque tube 1170. In the case of the large gas turbine 1000, almost half of the power generated by the turbine 1300 may be consumed to drive the compressor 1100.

The combustor 1200 may mix the compressed air supplied from the compressor 1100 with fuel for isobaric combustion to produce combustion gas with high energy. The combustor 1200 mixes fuel with introduced compressed air, burns a mixture thereof to produce high-temperature and high-pressure combustion gas with high energy, and increases the temperature of the combustion gas to a heat-resistant limit of combustor and turbine components through an isobaric combustion process.

A plurality of combustors constituting the combustor 1200 may be arranged in a form of a shell in a housing. Each of the combustors includes a burner having a fuel injection nozzle and the like, a combustor liner defining a combustion chamber, and a transition piece serving as a connector between the combustor and the turbine.

The high-temperature and high-pressure combustion gas discharged from the combustor 1200 is supplied to the turbine 1300. The supplied high-temperature and high-pressure combustion gas expands and applies impingement or reaction force to turbine blades 1400 to generate rotational torque. A portion of the rotational torque is transmitted via the torque tube 1170 to the compressor 1100, and remaining portion which is the excessive torque is used to drive a generator or the like.

The turbine 1300 includes a plurality of rotor disks 1310, a plurality of turbine blades 1400 radially arranged on each of the rotor disks 1310, and a plurality of turbine vanes 1500. Each of the rotor disks 1310 has a substantially disk shape and has a plurality of slots formed on an outer peripheral portion thereof. Each slot has a curved surface so that the turbine blades 1400 are inserted into respective slots. Each of the turbine blades 1400 may be coupled to the rotor disk 1310 in a dovetail coupling manner. The turbine vanes 1500 fixed to a housing are provided between the turbine blades 1400 to guide a flow direction of the combustion gas passing through the turbine blades 1400.

Figure 3:
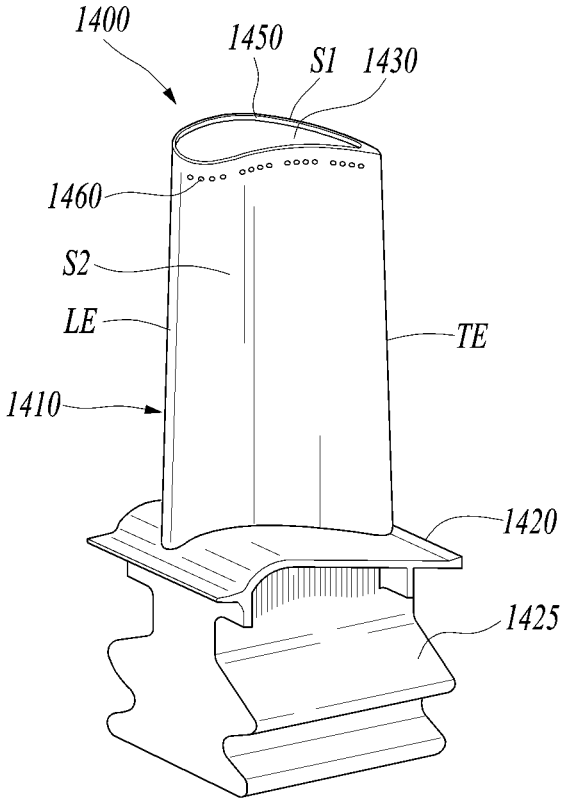
FIG. 3 is a perspective view illustrating a turbine blade according to the exemplary embodiment.
Figure 4:
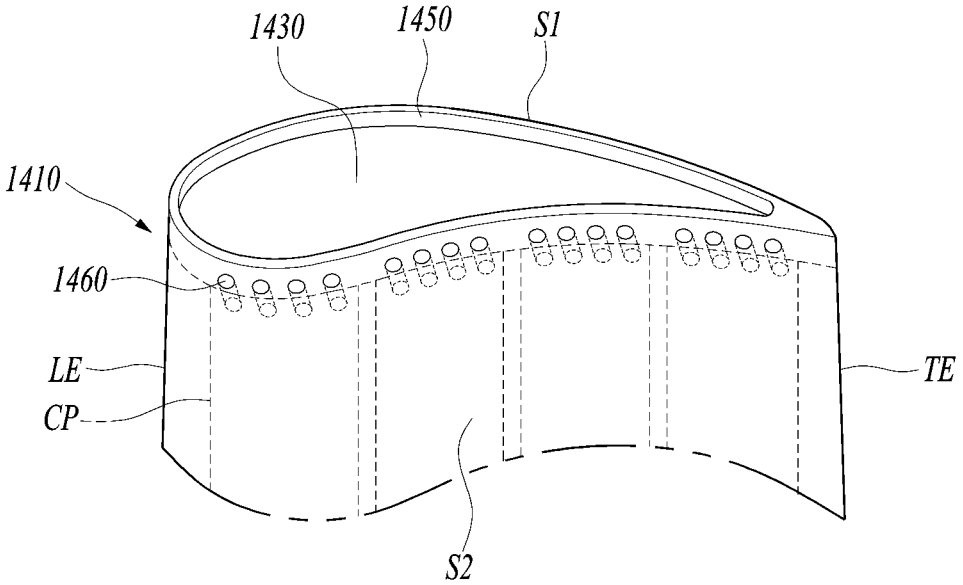
FIG. 4 is a partial perspective view illustrating the turbine blade according to a first exemplary embodiment.
Figure 5:
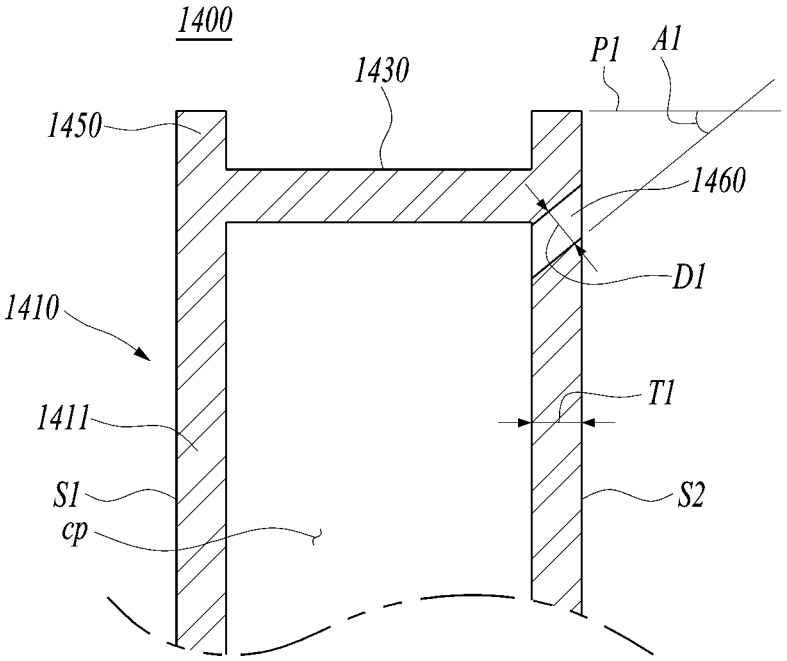
FIG. 5 is a partial longitudinal cross-sectional view illustrating the turbine blade according to the first exemplary embodiment.
Figure 6:
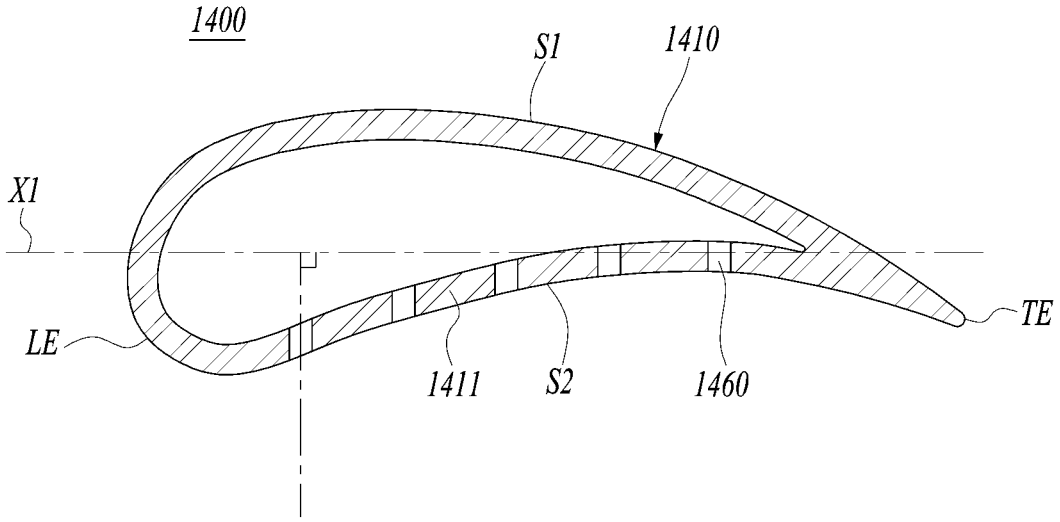
FIG. 6 is a partial transverse cross-sectional view illustrating the turbine blade according to the first exemplary embodiment.

FIG. 3 is a perspective view illustrating a turbine blade according to the exemplary embodiment. FIG. 4 is a partial perspective view illustrating the turbine blade according to a first exemplary embodiment. FIG. 5 is a partial longitudinal cross-sectional view illustrating the turbine blade according to the first exemplary embodiment. FIG. 6 is a partial transverse cross-sectional view illustrating the turbine blade according to the first exemplary embodiment.

Referring to FIGS. 3 to 6, the turbine blade 1400 includes an airfoil 1410, a platform 1420 coupled to a bottom of the airfoil 1410, and a root 1425 coupled to the rotor disk by protruding downward from the platform 1420. The airfoil 1410 may be formed of an airfoil-shaped curved plate and have an optimized shape according to specification of the gas turbine 1000.

The platform 1420 is positioned between the airfoil 1410 and the root 1425 and have an approximately square plate or square column shape. The platform 1420 has a side surface which is in contact with a side surface of the platform 1420 of an adjacent turbine blade 1400 to maintain a gap between the turbine blades 1400.

The root 1425 has a curved portion having a substantially fir-tree shape corresponding to the fir-tree-shaped curved portion formed in a slot of the rotor disk 1310. It is understood that the coupling structure of root 1425 is not limited thereto, and may be formed to have a dovetail structure. The root 1425 may have inlets formed at a lower end thereof for supplying cooling air.

The airfoil 1410 may have a leading edge LE disposed at an upstream side and a trailing edge TE disposed at a downstream side based on a flow direction of combustion gas. In addition, a suction side S1 protruding outward to have an outward-convex curved surface is formed on a front surface of the airfoil 1410 onto which the combustion gas is introduced, and a pressure side S2 having a curved surface depressed in a concave shape toward the suction side S1 is formed on a rear surface of the airfoil 1410. The pressure difference between the suction side S1 and the pressure side S2 of the airfoil 1410 allows the turbine 1300 to rotate.

The airfoil 1410 may have a plurality of cooling passages CP formed therein and air as a refrigerant may be supplied to the cooling passages CP. Each of the cooling passages CP may extend in a height direction of the airfoil 1410. The airfoil 1410 may be configured to perform only internal cooling without cooling holes, or alternatively may have a plurality of cooling holes formed on the outer surface thereof for film cooling.

The airfoil 1410 has a tip plate 1430 formed at a radially outer end thereof while facing the platform 1420. The tip plate 1430 is spaced apart from a shroud of the turbine 1300 with a gap therebetween. The tip plate 1430 is fixed to the sidewall of the airfoil 1410 to define a cooling space inside the sidewall. The tip plate 1430 has a shape corresponding to the transverse cross-section of the airfoil 1410. A rib 1450 protruding outwardly around the tip plate 1430 may be formed.

The airfoil 1410 may further include a discharge hole 1460 connected to each of the cooling passages CP for discharging cooling air. The turbine blade 1400 according to the first exemplary embodiment has no cooling hole for film cooling. The cooling air supplied into the turbine blade 1400 may be discharged through the discharge hole 1460 and the trailing edge TE after cooling the inside of the turbine blade 1400. The discharge hole 1460 is formed only on the pressure side S2 among the suction side S1 and the pressure side S2.

The discharge hole 1460 may be formed on a side surface of the cooling passage CP, e.g., at an upper end of the side surface. The discharge hole 1460 is connected to the pressure side S2 to discharge cooling air from the cooling passage CP to the pressure side S2. The discharge hole 1460 has a larger diameter than a typical cooling hole. The diameter D1 of the discharge hole 1460 may be larger than the thickness T1 of a wall surface 1411 of the turbine blade 1400.

The diameter D1 of the discharge hole 1460 may be 1.2 to 100 times the thickness T1 of the wall surface 1411 of the turbine blade 1400. This increases the velocity of air exiting through the discharge hole 1460 so that a large amount of air can be rapidly discharged. For example, 50 to 70% by weight of the air supplied to the turbine blade 1400 may be discharged through the discharge hole 1460.

The discharge hole 1460 may be inclined toward the tip of the turbine blade 1400 while extending from the inside to the outside thereof. The discharge hole 1460 forms an angle of inclination A1 with an imaginary plane P1 perpendicular to the height direction of the turbine blade 1400, and the angle of inclination A1 may be 5 to 15 degrees or 35 to 45 degrees.

Figure 7:
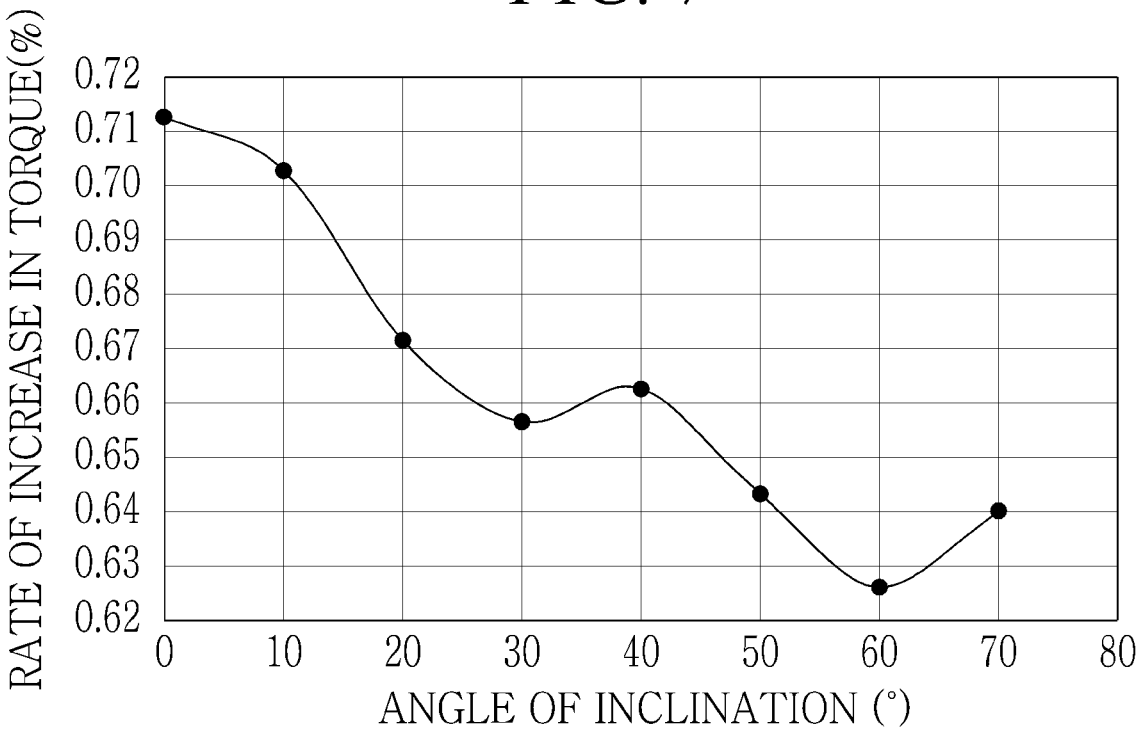
FIG. 7 is a graph illustrating a rate of increase in torque according to change in angle of inclination of a discharge hole formed in the turbine blade of the first exemplary embodiment.
Figure 8:
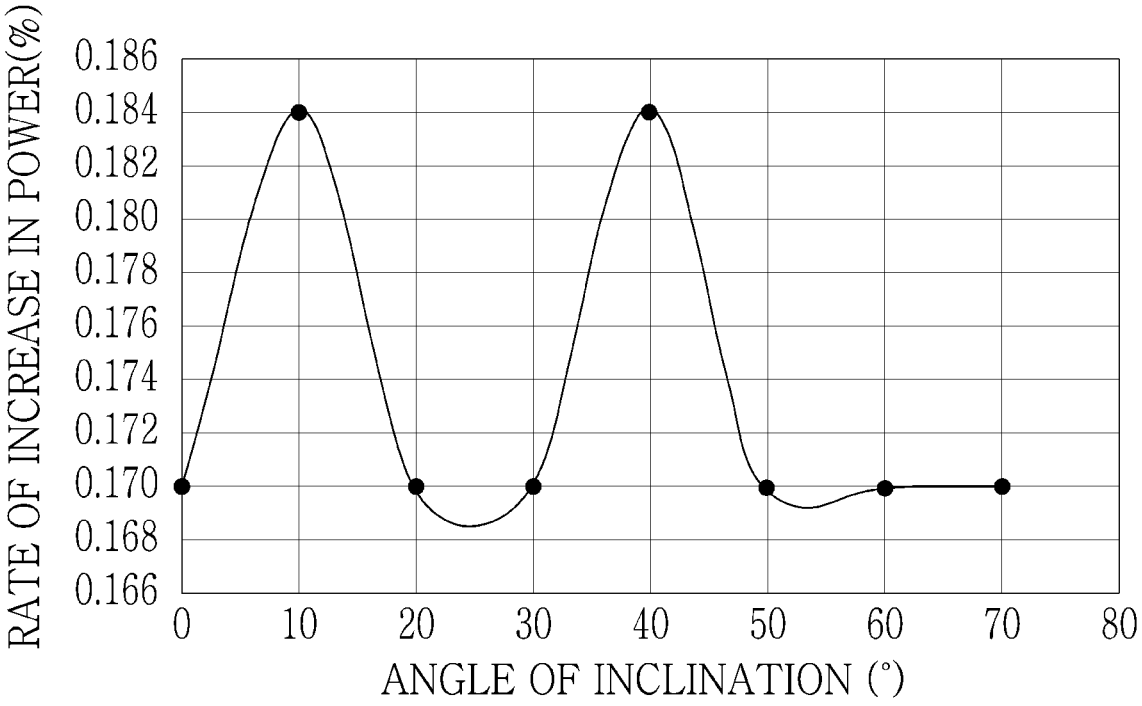
FIG. 8 is a graph illustrating a rate of increase in power according to change in angle of inclination of a discharge hole formed in the turbine blade of the first exemplary embodiment.

FIG. 7 is a graph illustrating a rate of increase in torque according to change in angle of inclination of the discharge hole formed in the turbine blade of the first exemplary embodiment. FIG. 8 is a graph illustrating a rate of increase in power according to change in angle of inclination of the discharge hole formed in the turbine blade of the first exemplary embodiment.

FIGS. 7 and 8 illustrate a rate of increase in torque and power of the gas turbine according to the change in angle of inclination when the gas turbine is operated at full speed and full load (FSFL) in which the rotational speed of the turbine blade 1400 is 3600 rpm, the compression ratio of the gas turbine is 18.16, and the ratio of the flow of the air exiting through the discharge hole 1460 to the flow of the combustion gas passing through the turbine blade 1400 is 0.6%.

As illustrated in FIGS. 7 and 8, when the angle of inclination A1 is 0 degrees, it can be seen that the gas turbine has the greatest torque value but low power. In addition, when the angle of inclination A1 is 0 degrees, air may not be properly introduced into the tip plate 1430.

On the other hand, when the angle of inclination A1 is greater than 50 degrees, the rate of increase in torque and the rate of increase in power may be lowered. In addition, when the angle of inclination A1 is 15 to 35 degrees, the power of the gas turbine may be lowered.

Meanwhile, the discharge hole 1460 may extend parallel to the direction of rotation of the turbine blade 1400. That is, the discharge hole 1460 may extend perpendicular to the direction of the central axis X1 of the turbine 1300. For example, the cooling hole formed in the turbine blade 1400 extends perpendicular to the curved surface of the turbine blade 1400. However, if the discharge hole 1460 extends perpendicular to the surface of the turbine blade 1400, it is difficult to sufficiently increase the rotational force of the turbine blade 1400.

On the other hand, if the discharge hole 1460 extends parallel to the rotational direction of the turbine blade 1400 and air is discharged in an opposite direction to the rotational direction of the turbine blade 1400, the air exiting through the discharge hole 1460 may increase the rotational force of the turbine blade 1400.

Figure 9:
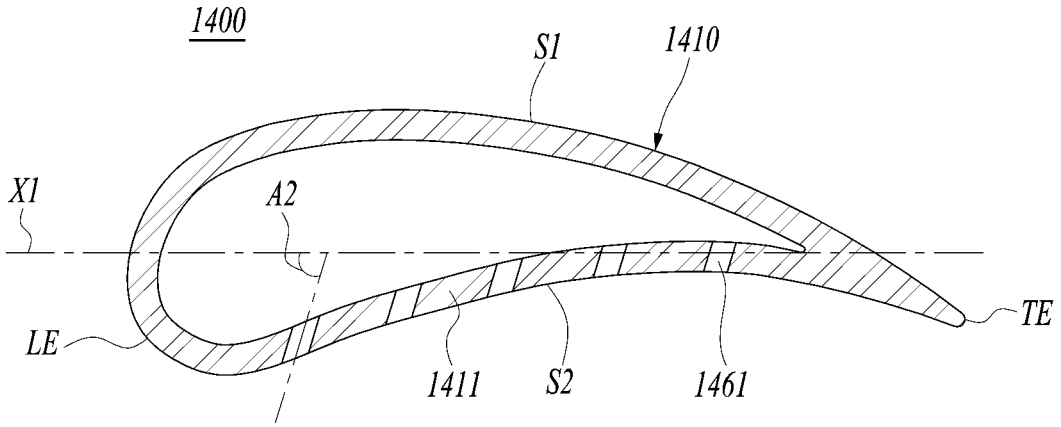
FIG. 9 is a partial transverse cross-sectional view illustrating a turbine blade according to a modification of the first exemplary embodiment.

However, the present disclosure is not limited thereto. As illustrated in FIG. 9, the discharge hole 1461 may also be inclined toward the leading edge LE while extending from the inside to the outside of the turbine blade 1400. That is, the discharge hole 1461 may be inclined at a preset angle of inclination A2 toward the central axis X1 of the turbine 1300, and the angle of inclination A2 may be 60 to 85 degrees.

Meanwhile, the velocity of the air exiting through the discharge hole 1460 is faster than the velocity of the air exiting through the related art cooling hole. In addition, a blowing ratio (BR) of the air exiting through the discharge hole 1460 and the gas passing through the turbine blade 1400 may be 4 to 10.

The blowing ratio is defined as the product of a discharge velocity VA of air exiting the turbine blade 1400 and a density DA of the air divided by the product of a velocity VG of combustion gas passing through the outer surface of the turbine blade 1400 and a density DG of the combustion gas.

That is, the blowing ratio BR may be expressed as the following Equation 1:

$$\text{Blowing Ratio(BR)}=(VA\times DA)/(VG\times DG) \quad \text{[Equation 1]}$$

If the blowing ratio is smaller than 4, the rate of increase in power of the turbine may be low. On the other hand, if the blowing ratio is larger than 10, the load of the compressor may increase. The tip plate 1430 is a closed plate connected to the suction side S1 and the pressure side S2, disposed on the outside, and has no opening. If the tip plate 1430 has a closed structure, a larger amount of air is discharged through the discharge hole 1460 to improve power and torque.

As described above, according to the first exemplary embodiment, because a plurality of inclined discharge holes 1460 are formed in the upper portion of the turbine blade 1400, the torque and power of the turbine 1400 can be improved by the force of air exiting the discharge holes 1460. In addition, it is possible to prevent leakage of pressure and cool the tip plate 1430 by delivering the air discharged from the discharge hole 1460 to the tip plate 1430.

Figure 10:
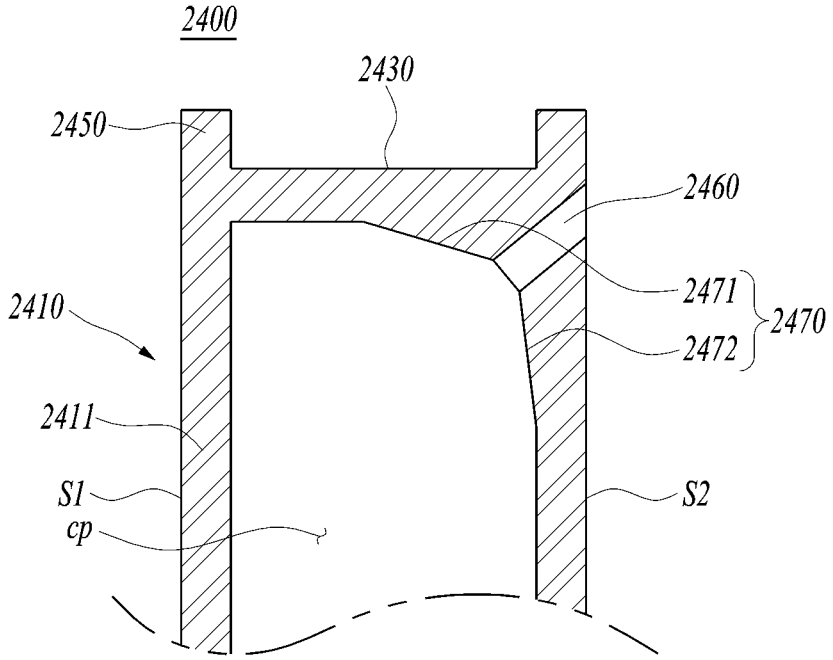
FIG. 10 is a partial longitudinal cross-sectional view illustrating a turbine blade according to a second exemplary embodiment.

Hereinafter, a turbine according to a second exemplary embodiment will be described. FIG. 10 is a partial longitudinal cross-sectional view illustrating a turbine blade according to a second exemplary embodiment.

Referring to FIG. 10, because the turbine according to the second exemplary embodiment has the same structure as the turbine according to the first exemplary embodiment except for a turbine blade 2400, a redundant description will be omitted.

The turbine blade 2400 according to the second exemplary embodiment includes an airfoil 2410. The airfoil 2410 may be formed of an airfoil-shaped curved plate and have an optimized shape according to specification of the turbine.

A suction side S1 protruding outward to have an outward-convex curved surface is formed on a front surface of the airfoil 2410 onto which the combustion gas is introduced, and a pressure side S2 having a curved surface depressed in a concave shape toward the suction side S1 is formed on a rear surface of the airfoil 2410.

The airfoil 2410 may have a plurality of cooling passages CP formed therein and air as a refrigerant may be supplied to the cooling passages CP. Each of the cooling passages CP may extend in the height direction of the airfoil 2410. The airfoil 2410 may be configured to perform only internal cooling without cooling holes, or alternatively may have a plurality of cooling holes formed on the outer surface thereof for film cooling.

The airfoil 2410 has a tip plate 2430 formed at a radially outer end thereof. The tip plate 2430 is spaced apart from a shroud of the turbine with a gap therebetween. A rib 2450 extending in a circumferential direction may be formed at the outer end of the tip plate 2430.

The airfoil 2410 may further include a discharge hole 2460 connected to each of the cooling passages CP for discharging cooling air. The discharge hole 2460 is formed only on the pressure side S2 among the suction side S1 and the pressure side S2. The discharge hole 2460 is formed to be inclined toward the tip of the turbine blade 2400 while extending from the inside to the outside thereof. The discharge hole 2460 may extend parallel to the rotational direction of the turbine blade 2400. The tip plate 2430 is a closed plate, disposed at the outer end of the airfoil 2410 and has no opening.

A flow extension 2470 may be formed at a corner where the tip plate 2430 meets a wall surface 2411 of the airfoil 2410 to protrude into the cooling passage CP. The flow extension 2470 may include an upper extension 2471 protruding inward from the tip plate 2430 and a side extension 2472 protruding inward from the pressure side S2.

The upper extension 2471 protrudes obliquely with respect to the inner surface of the tip plate 2430 and connects to the discharge hole 2460. In addition, the upper extension 2471 gradually decrease in thickness as it goes away from the discharge hole 2460. The side extension 2472 protrudes obliquely with respect to the pressure side S2 and connects to the discharge hole 2460. In addition, the side extension 2472 gradually decrease in thickness as it goes away from the discharge hole 2460.

As such, forming the flow extension 2470 may increase the length of the discharge hole 2460 and uniform the flow of cooling air. In addition, the upper extension 2471 and the side extension 2472 are formed obliquely with respect to the surface of the cooling passage CP, thereby preventing vortex generation and guiding air to the discharge hole 2460 to improve the blowing velocity of air.

Figure 11:
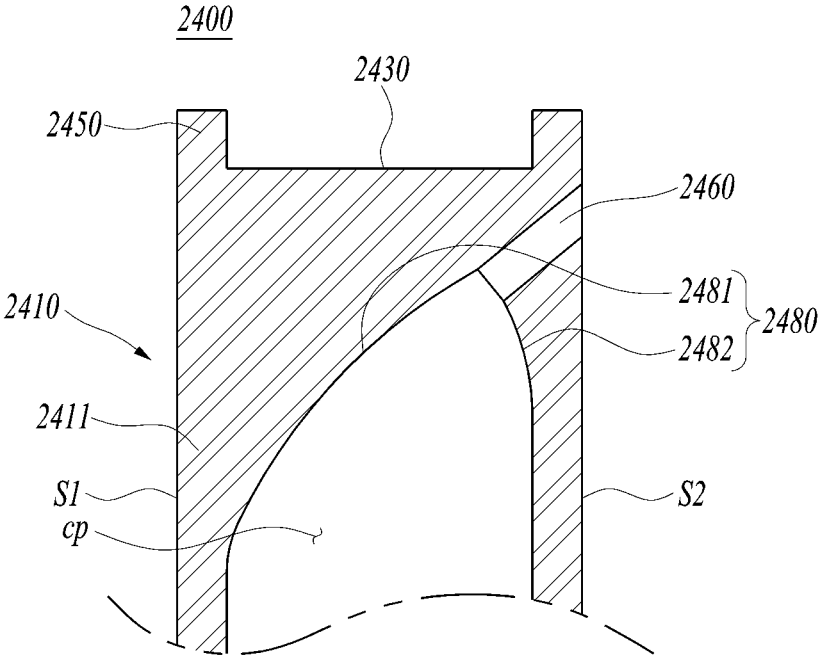
FIG. 11 is a partial longitudinal cross-sectional view illustrating a turbine blade according to a third exemplary embodiment.

Hereinafter, a turbine according to a third exemplary embodiment will be described. FIG. 11 is a partial longitudinal cross-sectional view illustrating a turbine blade according to a third exemplary embodiment.

Referring to FIG. 11, because the turbine according to the third exemplary embodiment has the same structure as the turbine according to the first exemplary embodiment except for a turbine blade 2400, a redundant description will be omitted.

The turbine blade 2400 according to the third exemplary embodiment includes an airfoil 2410. The airfoil 2410 may be formed of an airfoil-shaped curved plate and have an optimized shape according to specification of the turbine.

A suction side S1 protruding outward to have an outward-convex curved surface is formed on a front surface of the airfoil 2410 onto which the combustion gas is introduced, and a pressure side S2 having a curved surface depressed in a concave shape toward the suction side S1 is formed on a rear surface of the airfoil 2410.

The airfoil 2410 may have a plurality of cooling passages CP formed therein and air as a refrigerant may be supplied to the cooling passages CP. Each of the cooling passages CP may extend in the height direction of the airfoil 2410. The airfoil 2410 may be configured to perform only internal cooling without cooling holes, or alternatively may have a plurality of cooling holes formed on the outer surface thereof for film cooling.

The airfoil 2410 has a tip plate 2430 formed at a radially outer end thereof. The tip plate 2430 is spaced apart from a shroud of the turbine with a gap therebetween. A rib 2450 extending in a circumferential direction may be formed at the outer end of the tip plate 2430.

The airfoil 2410 may further include a discharge hole 2460 connected to each of the cooling passages CP for discharging cooling air. The discharge hole 2460 is formed only on the pressure side S2 among the suction side S1 and the pressure side S2. The discharge hole 2460 is formed to be inclined toward the tip of the turbine blade 2400 while extending from the inside to the outside thereof. The discharge hole 2460 may extend parallel to the rotational direction of the turbine blade 2400. The tip plate 2430 is a closed plate, disposed at the outer end of the airfoil 2410 and has no opening.

A flow guide 2480 may be formed at a corner where the tip plate 2430 meets a wall surface 2411 of the airfoil 2410 to guide the air exiting through the discharge hole 2460. The flow guide 2480 may include a first guide 2481 extending from the tip plate 2430 to the suction side S1 and a second guide 2482 protruding inward from the pressure side S2.

The first guide 2481 may protrude from the lower surface of the tip plate 2430 and the suction side S1 to be connected to the discharge hole 2460 and may have a curved surface. The second guide 2482 protrudes from the pressure side S2 and is connected to the discharge hole 2460.

As such, forming the flow guide 2480 may guide the air flowing from the inside to the outside of the cooling passage CP to the discharge hole 2460, thereby preventing the occurrence of a vortex and increasing the blowing velocity of air. In addition, because the flow guide 2480 becomes narrower toward the discharge hole 2460, the discharge velocity of air may be improved.

Hereinafter, a turbine according to a fourth exemplary embodiment will be described.

Figure 12:
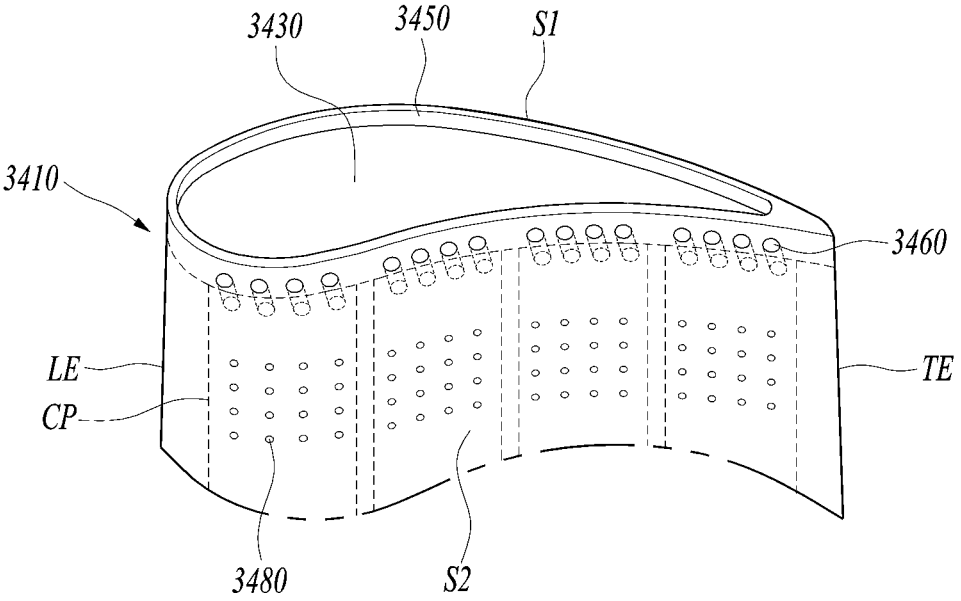
FIG. 12 is a partial perspective view illustrating a turbine blade according to a fourth exemplary embodiment.
Figure 13:
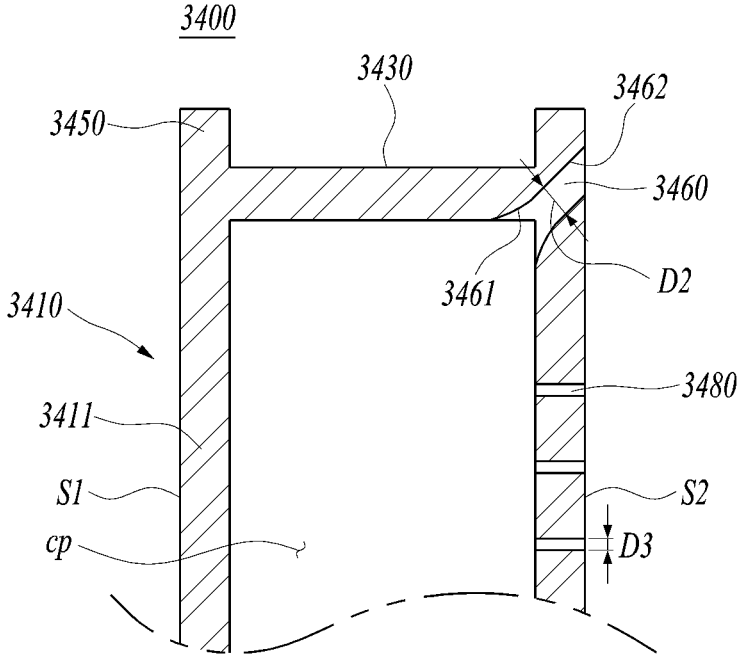
FIG. 13 is a partial longitudinal cross-sectional view illustrating the turbine blade according to the fourth exemplary embodiment.

FIG. 12 is a partial perspective view illustrating a turbine blade according to a fourth exemplary embodiment. FIG. 13 is a partial longitudinal cross-sectional view illustrating the turbine blade according to the fourth exemplary embodiment.

Referring to FIGS. 12 and 13, because the turbine according to the fourth exemplary embodiment has the same structure as the turbine according to the first exemplary embodiment except for a turbine blade 3400, a redundant description will be omitted.

The turbine blade 3400 according to the fourth exemplary embodiment includes an airfoil 3410. The airfoil 3410 may be formed of an airfoil-shaped curved plate and have an optimized shape according to specification of the gas turbine.

A suction side S1 protruding outward to have an outward-convex curved surface is formed on a front surface of the airfoil 3410 onto which the combustion gas is introduced, and a pressure side S2 having a curved surface depressed in a concave shape toward the suction side S1 is formed on a rear surface of the airfoil 3410.

The airfoil 3410 may have a plurality of cooling passages CP formed therein and air as a refrigerant may be supplied to the cooling passages CP. Each of the cooling passages CP may extend in the height direction a wall surface 3411 of the airfoil 3410. The airfoil 3410 may have a plurality of cooling holes 3480 formed for film cooling.

The airfoil 3410 has a tip plate 3430 formed at a radially outer end thereof. The tip plate 3430 is spaced apart from a shroud of the turbine with a gap therebetween. A rib 3450 extending in a circumferential direction may be formed at the outer end of the tip plate 3430.

The airfoil 3410 may further include a discharge hole 3460 connected to each of the cooling passages CP for discharging cooling air. Some of the cooling air flowing along the cooling passage CP may be discharged through the cooling hole 3480, and the remaining air may be discharged through the discharge hole 3460. The discharge hole 3460 is formed only on the pressure side S2 among the suction side S1 and the pressure side S2.

The discharge hole 3460 is formed to be inclined toward the tip of the turbine blade 3400 while extending from the inside to the outside thereof. The discharge hole 3460 and the cooling hole 3480 extend in different directions. The cooling hole 3480 may extend perpendicular to the curved surface of the turbine blade 3400, while the discharge hole 3460 may extend parallel to the rotational direction of the turbine blade 3400. In addition, the cooling hole 3480 may extend parallel to an imaginary plane perpendicular to the height direction of the turbine blade 3400, while the discharge hole 3460 may extend obliquely with respect to the imaginary plane perpendicular to the height direction of the turbine blade 3400.

The discharge hole 3460 may extend to the pressure side S2 at a corner where the tip plate 3430 meets the sidewall of the turbine blade 3400. In addition, the discharge hole 3460 may include a compression passage 3461 whose inner diameter gradually decreases to the outside, and a guide passage 3462 extending from the compression passage 3461 to the pressure side S2 and having a uniform inner diameter. By forming the compression passage 3461, the cooling air flowing along the cooling hole 3480 can be more easily introduced into the discharge hole 3460, and the compressed cooling air flowing along the discharge hole 3460 can be more strongly discharged.

The discharge holes 3460 are disposed outside the cooling holes 3480, and each of the discharge holes 3460 has a larger diameter than the cooling holes 3480. The minimum diameter D2 of the discharge hole 3460 may be 2 to 5 times the maximum diameter D3 of the cooling hole 3480.

In addition, the air blown through the discharge hole 3460 has a greater velocity than the air blown through the cooling hole 3480, and the blowing ratio at the discharge hole 3460 is higher than the blowing ratio at the cooling hole 3480.

Accordingly, a large amount of air is discharged through the discharge hole 3460, which can lead to an improvement in power and torque of the turbine blade 3400.

As described above, in the turbine blade and the turbine and gas turbine including the same according to the exemplary embodiments, because the discharge hole is inclined and formed only on the pressure side, it is possible to improve the torque and power of the turbine by the cooling air exiting through the discharge hole.

While one or more exemplary embodiments have been described with reference to the accompanying drawings, it will be apparent to those skilled in the art that various variations and modifications may be made by adding, changing, or removing components without departing from the spirit and scope of the disclosure as defined in the appended claims, and these variations and modifications fall within the spirit and scope of the disclosure as defined in the appended claims. Accordingly, the description of the exemplary embodiments should be construed in a descriptive sense only and not to limit the scope of the claims, and many alternatives, modifications, and variations will be apparent to those skilled in the art.

What is claimed is:

1. A turbine blade of a turbine comprising:

an airfoil having a suction side and a pressure side, a platform coupled to a bottom of the airfoil, and a root protruding downward from the platform and coupled to a rotor disk, wherein the airfoil comprises a cooling passage formed therein, a discharge hole connected to an upper portion of the cooling passage to discharge cooling air, and a plurality of cooling holes formed to discharge cooling air, wherein the discharge hole is inclined toward a tip of the turbine blade while extending from an inside to an outside thereof, wherein a diameter of the discharge hole is larger than a thickness of a sidewall of the turbine blade and is larger than a diameter of each of the plurality of cooling holes wherein a radially innermost point of an outlet of the discharge hole formed on the pressure side is disposed, with respect to a central axis of the turbine, higher than a radially outermost point of an outlet of each of the plurality of cooling holes formed on the pressure side; and the plurality of cooling holes extends in a first direction that is different from a second direction in which the discharge hole extends when viewed in a cross section along a thickness direction of the airfoil.

2. The turbine blade according to claim 1, wherein the discharge hole is formed only on the pressure side.

3. The turbine blade according to claim 2, wherein the discharge hole extends parallel to a rotational direction of the turbine blade.

4. The turbine blade according to claim 1, wherein the discharge hole is inclined toward a leading edge of the turbine blade while extending from the inside to the outside thereof.

5. The turbine blade according to claim 1, wherein the discharge hole forms an inclination angle with a plane perpendicular to a height direction of the turbine blade, the inclination angle being 5 to 15 degrees or 35 to 45 degrees.

6. The turbine blade according to claim 1, wherein the airfoil further comprises a tip plate connected to the suction side and the pressure side and disposed outward, the tip plate being a closed plate having no opening.

7. The turbine blade according to claim 6, wherein:

the cooling passage is provided with a flow extension connected to the discharge hole, the flow extension protruding into the cooling passage; and the flow extension comprises an upper extension protruding obliquely with respect to an inner surface of the tip plate and a side extension protruding obliquely with respect to the pressure side.

8. The turbine blade according to claim 6, wherein:

the cooling passage is provided with a flow guide connected to the discharge hole, the flow guide protruding into the cooling passage; and the flow guide comprises a first guide protruding from a lower surface of the tip plate and the suction side to be connected to the discharge hole and a second guide protruding from the pressure side to be connected to the discharge hole, the first guide being formed of a curved surface.

9. The turbine blade according to claim 1, wherein the discharge hole comprises a compression passage whose inner diameter gradually decreases outward, and a guide passage extending from the compression passage to the pressure side and having a uniform inner diameter, wherein a centerline extending from an inlet of the compression passage onto an outlet of the guide passage is straight.

10. The turbine blade according to claim 1, wherein:

a blowing ratio is defined as the product of a discharge velocity of air exiting the turbine blade and a density of the air divided by the product of a velocity of combustion gas passing through an outer surface of the turbine blade and a density of the combustion gas; and the blowing ratio of the air exiting through the discharge hole and the combustion gas passing through the turbine blade is 4 to 10.

11. A turbine comprising:

a rotor disk configured to be rotatable; and a plurality of turbine blades installed on the rotor disk, wherein each of the turbine blades comprises an airfoil having a suction side and a pressure side, a platform coupled to a bottom of the airfoil, and a root protruding downward from the platform and coupled to the rotor disk, wherein the airfoil comprises a cooling passage formed therein, a discharge hole connected to an upper portion of the cooling passage to discharge cooling air, and a plurality of cooling holes formed to discharge cooling air; and the discharge hole is inclined toward a tip of the turbine blade while extending from an inside to an outside thereof, and wherein a diameter of the discharge hole is larger than a thickness of a sidewall of the turbine blade and is larger than a diameter of each of the plurality of cooling holes wherein a radially innermost point of an outlet of the discharge hole formed on the pressure side is disposed, with respect to a central axis of the turbine, higher than a radially outermost point of an outlet of each of the plurality of cooling holes formed on the pressure side; and the plurality of cooling holes extends in a first direction that is different from a second direction in which the discharge hole extends when viewed in a cross section along a thickness direction of the airfoil.

12. The turbine according to claim 11, wherein the discharge hole is formed only in the pressure side among the suction side and the pressure side.

13. The turbine according to claim 12, wherein the discharge hole extends parallel to a rotational direction of the turbine blade.

14. The turbine according to claim 11, wherein the discharge hole is inclined toward a leading edge of the turbine blade while extending from the inside to the outside thereof.

15. The turbine according to claim 11, wherein the discharge hole forms an inclination angle with a plane perpendicular to a height direction of the turbine blade, the inclination angle being 5 to 15 degrees or 35 to 45 degrees.

16. The turbine according to claim 11, wherein the airfoil further comprises a tip plate connected to the suction side and the pressure side and disposed outward, the tip plate being a closed plate having no opening.

17. The turbine according to claim 16, wherein:

the cooling passage is provided with a flow extension connected to the discharge hole, the flow extension protruding into the cooling passage; and the flow extension comprises an upper extension protruding obliquely with respect to an inner surface of the tip plate and a side extension protruding obliquely with respect to the pressure side.

18. A gas turbine comprising:

a compressor configured to compress air introduced thereinto from an outside;

a combustor configured to mix fuel with air compressed by the compressor for combustion; and a turbine including a plurality of turbine blades rotated by combustion gas produced by the combustor, wherein each of the turbine blades comprises an airfoil having a suction side and a pressure side, a platform coupled to a bottom of the airfoil, and a root protruding downward from the platform and coupled to the rotor disk, wherein the airfoil comprises a cooling passage formed therein, a discharge hole connected to an upper portion of the cooling passage to discharge cooling air, and a plurality of cooling holes formed to discharge cooling air; and the discharge hole is inclined toward a tip of the turbine blade while extending from an inside to an outside thereof, and wherein a diameter of the discharge hole is larger than a thickness of a sidewall of the turbine blade and is larger than a diameter of each of the plurality of cooling holes wherein a radially innermost point of an outlet of the discharge hole formed on the pressure side is disposed, with respect to a central axis of the turbine, higher than a radially outermost point of an outlet of each of the plurality of cooling holes formed on the pressure side; and the plurality of cooling holes extends in a first direction that is different from a second direction in which the discharge hole extends when viewed in a cross section along a thickness direction of the airfoil.

* * * * *